US007961207B2

(12) United States Patent
Noda

(10) Patent No.: US 7,961,207 B2
(45) Date of Patent: Jun. 14, 2011

(54) IMAGE GENERATING APPARATUS

(75) Inventor: Yutaka Noda, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 1056 days.

(21) Appl. No.: 11/752,679

(22) Filed: May 23, 2007

(65) Prior Publication Data

US 2007/0273745 A1 Nov. 29, 2007

(30) Foreign Application Priority Data

May 23, 2006 (JP) ..... 2006-142618

(51) Int. Cl.
*B41J 2/32* (2006.01)
*B41J 2/165* (2006.01)

(52) U.S. Cl. ..... 347/171; 347/22

(58) Field of Classification Search ..... 347/171, 347/22

See application file for complete search history.

(56) References Cited

U.S. PATENT DOCUMENTS

| | | | | |
|---|---|---|---|---|
| 5,563,646 | A * | 10/1996 | Fukuda | 347/171 |
| 5,936,658 | A * | 8/1999 | Kato et al. | 347/247 |
| 6,683,636 | B2 | 1/2004 | Goto et al. | |

FOREIGN PATENT DOCUMENTS

| | | | |
|---|---|---|---|
| JP | 60-15173 | A | 1/1985 |
| JP | 5-51659 | U | 7/1993 |
| JP | 6-32044 | U | 4/1994 |
| JP | 11-115276 | A | 4/1999 |
| JP | 2002-103737 | A | 4/2002 |
| JP | 2003-260809 | A | 9/2003 |

* cited by examiner

*Primary Examiner* — Julian D Huffman
*Assistant Examiner* — Jason S Uhlenhake
(74) *Attorney, Agent, or Firm* — Crowell & Moring LLP

(57) ABSTRACT

This image generating apparatus comprises an ink sheet cartridge storing an ink sheet. When sensing arrival of the rear end of the ink sheet, the image generating apparatus cleans the print head by rotating the print head between a printing position and a nonprinting position (separate position) thereby dropping foreign matter adhering to the print head onto the ink sheet.

15 Claims, 11 Drawing Sheets

IMAGE GENERATING APPARATUS

BACKGROUND OF THE INVENTION

1. Field of the Invention

The present invention relates to an image generating apparatus, and more particularly, it relates to an image generating apparatus comprising a print head.

2. Description of the Background Art

Image generating apparatuses comprising print heads are known in general, as disclosed in Japanese Utility Model Laying-Open Nos. 6-32044 (1994) and 5-51659 (1993) and Japanese Patent Laying-Open Nos. 2003-260809, 2002-103737, 11-115276 (1999) and 60-15173 (1985), for example.

The aforementioned Japanese Utility Model Laying-Open No. 6-32044 discloses an image generating apparatus mounted with a thermal transfer ribbon including an ink sheet end mark portion provided on the terminal of an ink sheet for indicating the termination of the ink sheet and a cleaning portion provided on a position deviating from the forward end of the ink sheet end mark portion toward the terminal of the ink sheet by a constant distance for cleaning a print head. When a sensor provided on the body of this image generating apparatus senses the ink sheet end mark portion in a printing operation, the image generating apparatus completes the printing up to the remaining region of the ink sheet. Thereafter the image generating apparatus removes dirt (dust) adhering to a heating element portion of the print head by pressing the print head against the cleaning portion.

The aforementioned Japanese Utility Model Laying-Open No. 5-51659 discloses an image generating apparatus having a cleaning pad provided on an end of a platen roller for removing dirt (dust) adhering to a print head by moving the print head up to the end of the platen roller along the axial direction of the platen roller while pressing the print head against the cleaning pad upon power supply to the image generating apparatus or in synchronization with an exchange of a ribbon cartridge. The cleaning pad is infiltrated with a solvent, which is replenished by the user when the cleaning pad is dried.

The aforementioned Japanese Patent Laying-Open No. 2003-260809 discloses an image generating apparatus having a photocatalytic layer of titanium oxide provided on the surface of a print head as well as an ultraviolet fluorescent lamp and a reflecting mirror provided in the body of the apparatus. This image generating apparatus removes dirt (dust) adhering to the print head through photodecomposition by applying ultraviolet light from the ultraviolet fluorescent lamp to the print head through the reflecting mirror every time the apparatus completes printing on a paper.

The aforementioned Japanese Patent Laying-Open No. 2002-103737 discloses an image generating apparatus comprising a suction member, having suction holes on a surface coming into contact with a printing/recording paper, provided on an upstream side beyond a print head along a paper feed direction for removing dust from the surface of the printing/recording paper in contact with the suction member by sucking air through the suction holes.

The aforementioned Japanese Patent Laying-Open No. 11-115276 discloses an image generating apparatus comprising an air bag and a nozzle provided in the body thereof, while the air bag is formed by an elastic member having a prescribed thickness to be deformed when receiving external force and self-reset to the original shape when released from the external force. When a cover of the body of the apparatus is closed in printing, a pressing portion provided on the cover presses and deforms the air bag, thereby blowing air from the air bag to a space between a platen roller and a print head for removing dust adhering to the print head or the platen roller.

The aforementioned Japanese Patent Laying-Open No. 60-15173 discloses an image generating apparatus applying a heating temperature higher than that in a printing operation to a print head in an idle period thereby melting dirt such as resin adhering to the print head.

In the conventional image generating apparatus proposed in the aforementioned Japanese Utility Model Laying-Open No. 6-32044, however, the thermal transfer ribbon must be newly provided with the dedicated cleaning portion for cleaning the print head, disadvantageously leading to a complicated structure of the thermal transfer ribbon.

In the conventional image generating apparatus proposed in the aforementioned Japanese Utility Model Laying-Open No. 5-51659, the platen roller must be newly provided with the dedicated cleaning pad for cleaning the print head on the end thereof, disadvantageously leading to a complicated structure of the platen roller.

The conventional image generating apparatus proposed in the aforementioned Japanese Patent Laying-Open No. 2003-260809 must be newly provided with a cleaning-only optical system including the ultraviolet fluorescent lamp and the reflecting mirror for applying the from the ultraviolet fluorescent lamp to the print head in order to clean the print head through a photocatalytic effect. Therefore, the structure of the image generating apparatus is disadvantageously complicated.

The conventional image generating apparatus proposed in the aforementioned Japanese Patent Laying-Open No. 2002-103737 must be newly provided with the air suction mechanism for cleaning on the body thereof. Therefore, the structure of the image generating apparatus is disadvantageously complicated.

The conventional image generating apparatus proposed in the aforementioned Japanese Patent Laying-Open No. 11-115276 must be newly provided with the air bag and the nozzle for removing dust as well as the mechanism for deforming the air bag on the body thereof. Therefore, the structure of the image generating apparatus is disadvantageously complicated.

The conventional image generating apparatus proposed in the aforementioned Japanese Patent Laying-Open No. 60-15173, melting and removing the dirt such as resin, cannot remove thermally infusible foreign matter. Thus, this image generating apparatus is disadvantageously insufficient in cleaning function for the print head.

SUMMARY OF THE INVENTION

The present invention has been proposed in order to solve the aforementioned problems, and an object of the present invention is to provide an image generating apparatus capable of cleaning a print head with no requirement for any additional structure and also capable of removing thermally infusible foreign matter.

An image generating apparatus according to a first aspect of the present invention comprises an apparatus body including a print head provided to be rotatable between a printing position where the print head is pressed against a platen roller and a nonprinting position where the print head is separated from the platen roller and an ink sheet cartridge, detachably mounted on the apparatus body, storing an ink sheet held between the print head and the platen roller in printing and cleans the print head by rotating the print head between the printing position and the nonprinting position thereby dropping foreign matter adhering to the print head onto the ink sheet when sensing arrival of the rear end of the ink sheet.

The image generating apparatus according to the first aspect of the present invention, cleaning the print head by rotating the print head between the printing position and the nonprinting position thereby dropping foreign matter adhering to the print head onto the ink sheet when sensing arrival of the rear end of the ink sheet as hereinabove described, can clean the print head simply through an additional operation similar to the operation of rotating the print head in printing with no requirement for any additional structure. Further, the image generating apparatus, cleaning the print head by dropping the foreign matter onto the ink sheet, can also drop thermally infusible foreign matter for removing the same. The image generating apparatus drops the foreign matter onto the ink sheet for discharging the same along with the ink sheet cartridge when the ink sheet cartridge is exchanged, whereby the foreign matter can be prevented from remaining in the apparatus.

In the aforementioned image generating apparatus according to the first aspect, the print head is preferably brought into contact with the ink sheet when rotated to the printing position in cleaning of the print head. According to this structure, the print head is so brought into contact with the ink sheet in cleaning that the image generating apparatus can transfer the foreign matter from the print head onto the surface of the ink sheet in addition to the function of dropping the same onto the ink sheet.

The aforementioned image generating apparatus according to the first aspect preferably performs at least an operation of rotating the print head from the printing position to the nonprinting position in cleaning at a rotational speed higher than that for rotating the print head in printing. According to this structure, the image generating apparatus, capable of reliably separating the foreign matter from the print head and dropping the same onto the ink sheet, can more reliably clean the print head. Consequently, the image generating apparatus can be improved in cleaning ability.

In the aforementioned image generating apparatus according to the first aspect, the nonprinting position for the print head preferably includes a first nonprinting position where the print head is arranged when the image generating apparatus searches for the ink sheet in printing and a second nonprinting position, higher than the first nonprinting position, where the print head is arranged after completion of printing, so that the image generating apparatus cleans the print head by rotating the print head between the printing position and the second nonprinting position. According to this structure, the rotational range of the print head can be so enlarged that the image generating apparatus can more reliably remove the foreign matter. Thus, the image generating apparatus can be further improved in cleaning ability.

The aforementioned image generating apparatus according to the first aspect preferably performs an operation of rotating the print head in cleaning by rotating the print head between the printing position and the nonprinting position a plurality of times. According to this structure, the image generating apparatus, rotating the print head a plurality of times, can more reliably remove the foreign matter. Thus, the image generating apparatus can be further improved in cleaning ability.

The aforementioned image generating apparatus according to the first aspect preferably further comprises an ink sheet sensor for searching for the ink sheet by sensing a prescribed region of the ink sheet, for sensing arrival of the rear end of the ink sheet and cleaning the print head when the ink sheet sensor no longer senses the prescribed region of the ink sheet. According to this structure, the image generating apparatus, capable of sensing arrival of the rear end of the ink sheet with the existing ink sheet sensor for searching for the ink sheet, can clean the print head with no requirement for any additional structure.

In this case, the ink sheet preferably includes an ink sheet search identification portion provided on the prescribed region, so that the image generating apparatus senses arrival of the rear end of the ink sheet if the ink sheet sensor does not sense the ink sheet search identification portion upon carriage of the ink sheet by a prescribed length. According to this structure, the image generating apparatus can easily sense arrival of the rear end of the ink sheet through the ink sheet search identification portion and the ink sheet sensor.

The aforementioned image generating apparatus according to the first aspect preferably further comprises an alarm portion prompting the user to exchange the ink sheet cartridge after completely cleaning the print head. According to this structure, the image generating apparatus can prompt the user to exchange the ink sheet cartridge with the alarm portion when completely cleaning the print head, thereby reliably discharging the foreign matter adhering to the print head along with the used ink sheet cartridge.

In this case, the alarm portion preferably includes a light-emitting device portion. According to this structure, the image generating apparatus can more reliably prompt the user to exchange the ink sheet cartridge by switching on or blinking the light-emitting device portion after completely cleaning the print head.

The aforementioned image generating apparatus according to the first aspect preferably further comprises a plurality of rotatable pressing members pressing the print head against the platen roller, for rotating the print head between the printing position and the nonprinting position by rotating the pressing members. According to this structure, the image generating apparatus, capable of pressing and rotating the horizontally long print head having a prescribed printing width in the longitudinal direction with the plurality of pressing members, can more reliably rotate the print head.

An image generating apparatus according to a second aspect of the present invention comprises an apparatus body including a print head provided to be rotatable between a printing position where the print head is pressed against a platen roller and a nonprinting position where the print head is separated from the platen roller and an ink sheet cartridge, detachably mounted on the apparatus body, storing an ink sheet held between the print head and the platen roller in printing, cleans the print head by rotating the print head between the printing position and the nonprinting position thereby dropping foreign matter adhering to the print head onto the ink sheet when sensing arrival of the rear end of the ink sheet and performs at least an operation of rotating the print head from the printing position to the nonprinting position in cleaning at a rotational speed higher than that for rotating the print head in printing, the nonprinting position for the print head includes a first nonprinting position where the print head is arranged when the image generating apparatus searches for the ink sheet in printing and a second nonprinting position, higher than the first nonprinting position, where the print head is arranged after completion of printing so that the image generating apparatus cleans the print head by rotating the print head between the printing position and the second nonprinting position, the image generating apparatus performs the operation of rotating the print head in cleaning by rotating the print head between the printing position and the nonprinting position a plurality of times, and the image generating apparatus further comprises an ink sheet sensor for searching for the ink sheet by sensing a prescribed region of the ink sheet for sensing arrival of the rear end of the ink sheet and cleaning the print head when the ink sheet sensor no longer senses the prescribed region of the ink sheet.

The image generating apparatus according to the second aspect of the present invention, cleaning the print head by rotating the print head between the printing position and the nonprinting position thereby dropping foreign matter adhering to the print head onto the ink sheet when sensing arrival of the rear end of the ink sheet as hereinabove described, can clean the print head simply through an additional operation similar to the operation of rotating the print head in printing with no requirement for any additional structure. Further, the image generating apparatus, cleaning the print head by dropping the foreign matter onto the ink sheet, can also drop thermally infusible foreign matter for removing the same. The image generating apparatus drops the foreign matter onto the ink sheet for discharging the same along with the ink sheet cartridge when the ink sheet cartridge is exchanged, whereby the foreign matter can be prevented from remaining in the apparatus. Further, the image generating apparatus performs at least the operation of rotating the print head from the printing position to the nonprinting position in cleaning at the rotational speed higher than that for rotating the print head in printing. Thus, the image generating apparatus, capable of reliably separating the foreign matter from the print head and dropping the same onto the ink sheet, can more reliably clean the print head. Consequently, the image generating apparatus can be improved in cleaning ability. In addition, the image generating apparatus cleans the print head by rotating the print head between the printing position and the second nonprinting position higher than the first nonprinting position where the print head is arranged when the image generating apparatus searches for the ink sheet in printing, whereby the rotational range of the print head can be so enlarged that the image generating apparatus can more reliably remove the foreign matter. Thus, the image generating apparatus can be further improved in cleaning ability. Further, the image generating apparatus performs the operation of rotating the print head in cleaning by rotating the print head between the printing position and the nonprinting position a plurality of times, whereby the image generating apparatus, rotating the print head a plurality of times, can more reliably remove the foreign matter. Thus, the image generating apparatus can be further improved in cleaning ability. Further, the image generating apparatus senses arrival of the rear end of the ink sheet and cleans the print head when the ink sheet sensor for searching for the ink sheet by sensing the prescribed region thereof no longer senses this prescribed region, whereby the image generating apparatus, capable of sensing arrival of the rear end of the ink sheet with the existing ink sheet sensor for searching for the ink sheet, can clean the print head with no requirement for any additional structure.

In the aforementioned image generating apparatus according to the second aspect, the print head is preferably brought into contact with the ink sheet when rotated to the printing position in cleaning of the print head. According to this structure, the print head is so brought into contact with the ink sheet in cleaning that the image generating apparatus can transfer the foreign matter from the print head onto the surface of the ink sheet in addition to the function of dropping the same onto the ink sheet.

In the aforementioned image generating apparatus according to the second aspect, the ink sheet preferably includes an ink sheet search identification portion provided on the prescribed region, so that the image generating apparatus senses arrival of the rear end of the ink sheet if the ink sheet sensor does not sense the ink sheet search identification portion upon carriage of the ink sheet by a prescribed length. According to this structure, the image generating apparatus can easily sense arrival of the rear end of the ink sheet through the ink sheet search identification portion and the ink sheet sensor.

The aforementioned image generating apparatus according to the second aspect preferably further comprises an alarm portion prompting the user to exchange the ink sheet cartridge after completely cleaning the print head. According to this structure, the image generating apparatus can prompt the user to exchange the ink sheet cartridge with the alarm portion when completely cleaning the print head, thereby reliably discharging the foreign matter adhering to the print head along with the used ink sheet cartridge.

In this case, the alarm portion preferably includes a light-emitting device portion. According to this structure, the image generating apparatus can more reliably prompt the user to exchange the ink sheet cartridge by switching on or blinking the light-emitting device portion after completely cleaning the print head.

The aforementioned image generating apparatus according to the second aspect preferably further comprises a plurality of rotatable pressing members pressing the print head against the platen roller, for rotating the print head between the printing position and the nonprinting position by rotating the pressing members. According to this structure, the image generating apparatus, capable of pressing and rotating the horizontally long print head having a prescribed printing width in the longitudinal direction with the plurality of pressing members, can more reliably rotate the print head.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention is now described with reference to the drawings.

First, the structure of a thermal transfer printer according to the embodiment of the present invention is described with reference to FIGS. 1 to 10. This embodiment of the present invention is applied to the thermal transfer printer, which is an exemplary image generating apparatus.

Figure 1:
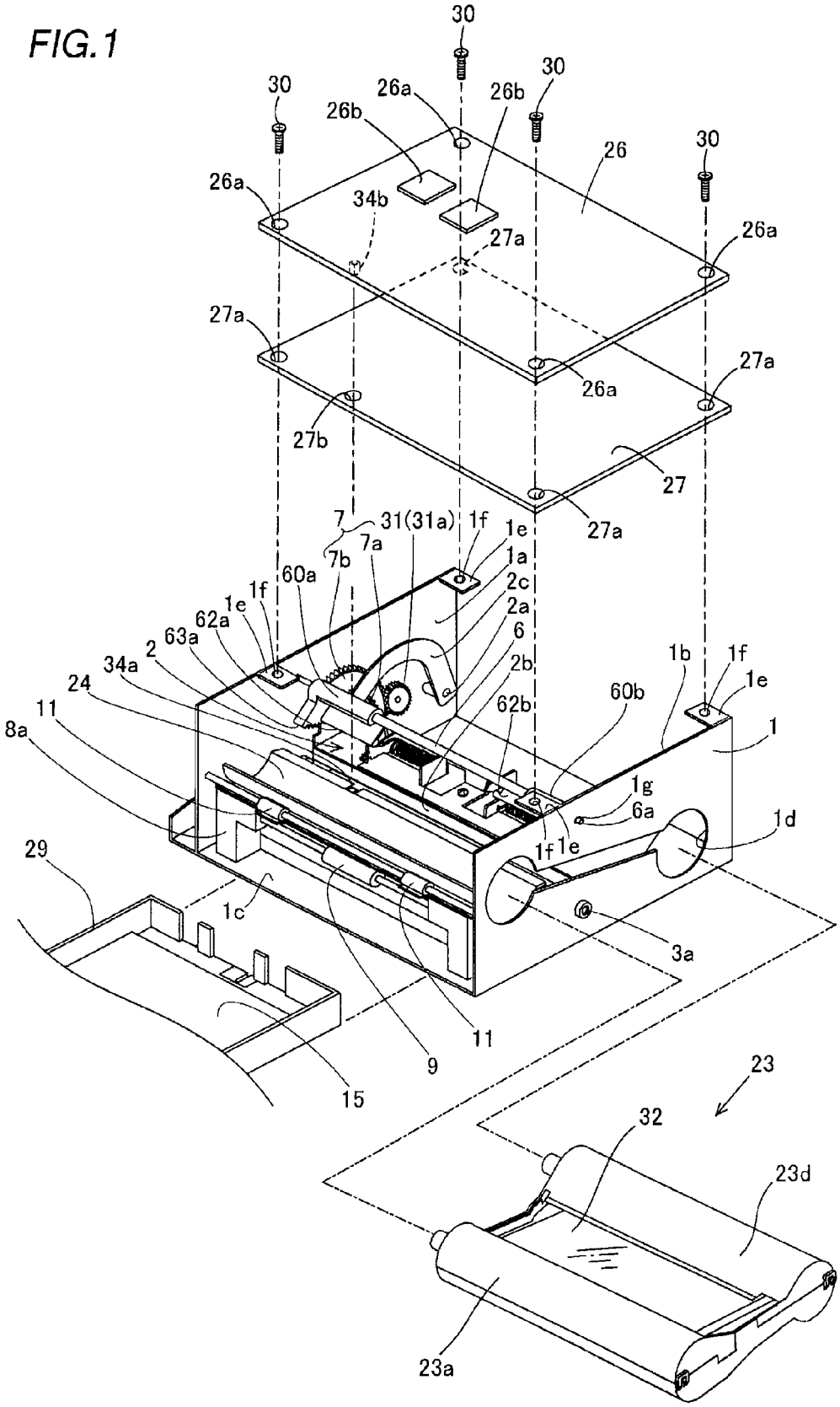
FIG. 1 is an exploded perspective view showing the overall structure of a thermal transfer printer according to an embodiment of the present invention.

As shown in FIG. 1, the body of the thermal transfer printer according to the embodiment of the present invention comprises a chassis 1 of metal, a horizontally long print head 2 having a prescribed printing width in the longitudinal direction, a platen roller 3 (see FIG. 5) opposed to the print head 2, a feed roller 4 (see FIG. 5) of metal, a press roller 5 (see FIG. 5) of metal pressing the feed roller 4 with prescribed pressing force, a support rod 6 of metal, a drive gear 7 of resin, a lower paper guide 8*a* of resin, an upper paper guide 8*b* (see FIG. 6) of resin, a paper feed roller 9 of rubber, a paper feed roller gear 10 (see FIG. 6), a paper discharge roller 11 of rubber, a paper discharge roller gear 12 (see FIG. 6), an ink sheet take-up reel 13 (see FIG. 6), a motor bracket 14 (see FIG. 6), a stepping motor 16 (see FIG. 6) for carrying each paper 15, another stepping motor 17 (see FIG. 6) for rotating the print head 2, a swingable swing gear 18 (see FIG. 6), a plurality of intermediate gears 19 to 22 (see FIG. 7), an ink sheet cartridge support portion 24 supporting an ink sheet cartridge 23, a wiring board 26 provided with a circuit portion 25 (see FIG. 2) controlling operations of the thermal transfer printer, a top plate 27 and a housing 28 (see FIG. 3) storing the chassis 1 therein. The ink sheet cartridge 23 storing an ink sheet 32 capable of printing images on 20 papers 15 and a paper feed cassette case 29 for storing the papers 15 fed to the thermal transfer printer are detachably mounted on the thermal transfer printer according to this embodiment.

Figure 5:
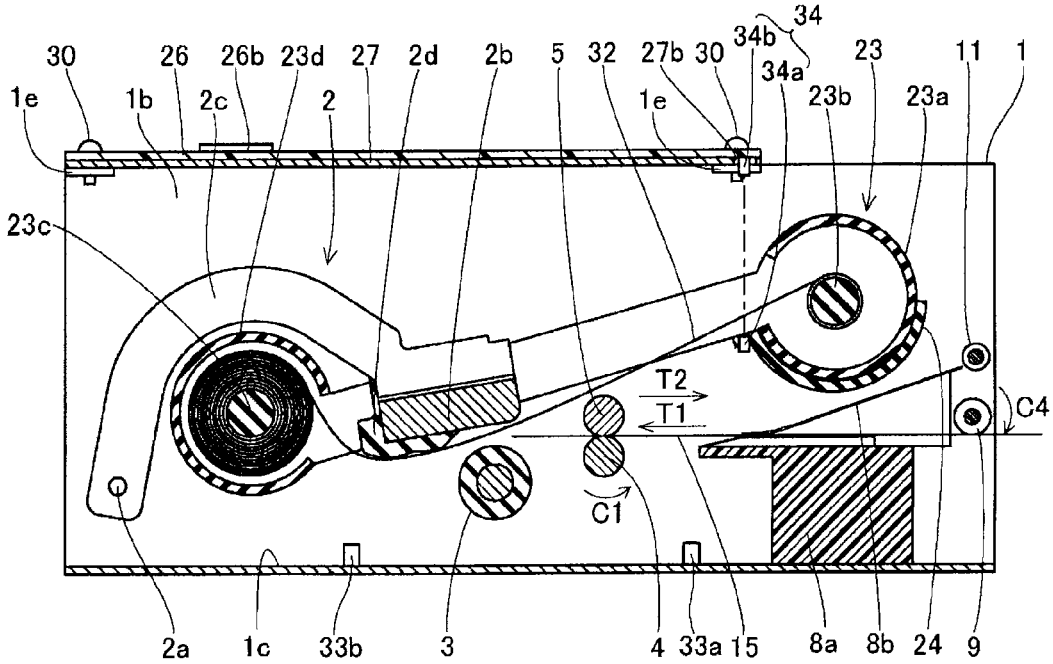
FIG. 5 is a sectional view of the thermal transfer printer according to the embodiment of the present invention shown in FIG. 1.

The chassis 1 has first and second side surfaces 1*a* and 1*b* opposed to each other and a bottom surface 1*c*, as shown in FIG. 1. The aforementioned motor bracket 14 is mounted on the first side surface 1*a* of the chassis 1. A receiving hole 1*d* for receiving the ink sheet cartridge 23 is provided on the second side surface 1*b* of the chassis 1. Two pairs of mounting portions 1*e* for mounting the wiring board 26 are formed on the upper ends of the first and second side surfaces 1*a* and 1*b* respectively. The four mounting portions 1*e* are provided with threaded holes 1*f* meshing with four screws 30 for fixing the wiring board 26 respectively. As shown in FIG. 5, paper sensors 33*a* and 33*b* are provided on the bottom surface 1*c* of the chassis 1 for detecting the front and rear ends of each paper 15 respectively.

Figure 6:
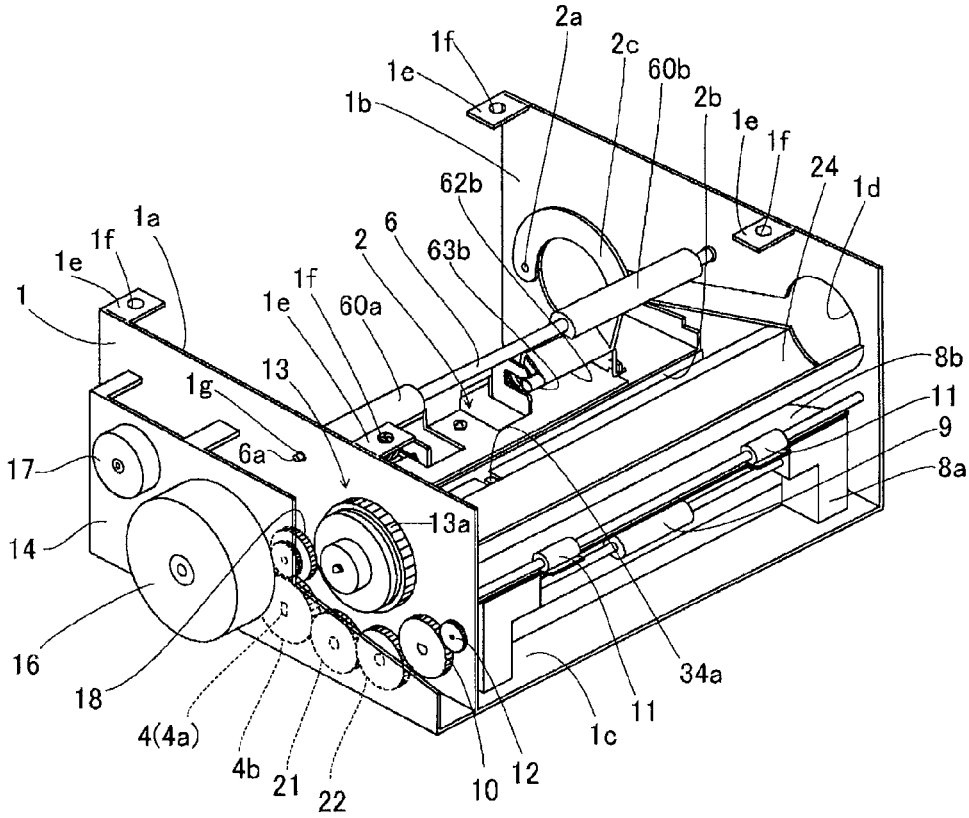
FIG. 6 is a perspective view of the thermal transfer printer according to the embodiment of the present invention shown in FIG. 1.

Support holes 1*g* for rotatably supporting the support rod 6 of metal are provided on the first and second side surfaces 1*a* and 1*b* of the chassis 1 respectively. Two platen roller bearings 3*a* (see FIG. 8) are mounted on the first and second side surfaces 1*a* and 1*b* of the chassis 1 respectively, for rotatably supporting the platen roller 3. The feed roller 4 has a feed roller gear insertional portion 4*a* inserted into a feed roller gear 4*b*, as shown in FIG. 6. The feed roller 4 is rotatably supported by a feed roller bearing (not shown) mounted on the chassis 1. The press roller 5 (see FIG. 5) is rotatably supported by a press roller bearing (not shown). The feed roller 4 and the press roller 5 have functions of carrying each paper 15 in a paper feed direction (along arrow T1) or a paper discharge direction (along arrow T2) by rotating while holding the paper 15 therebetween. The paper feed roller 9 has a function of introducing each paper 15 placed on the paper feed cassette 29 into the chassis 1.

Figure 8:
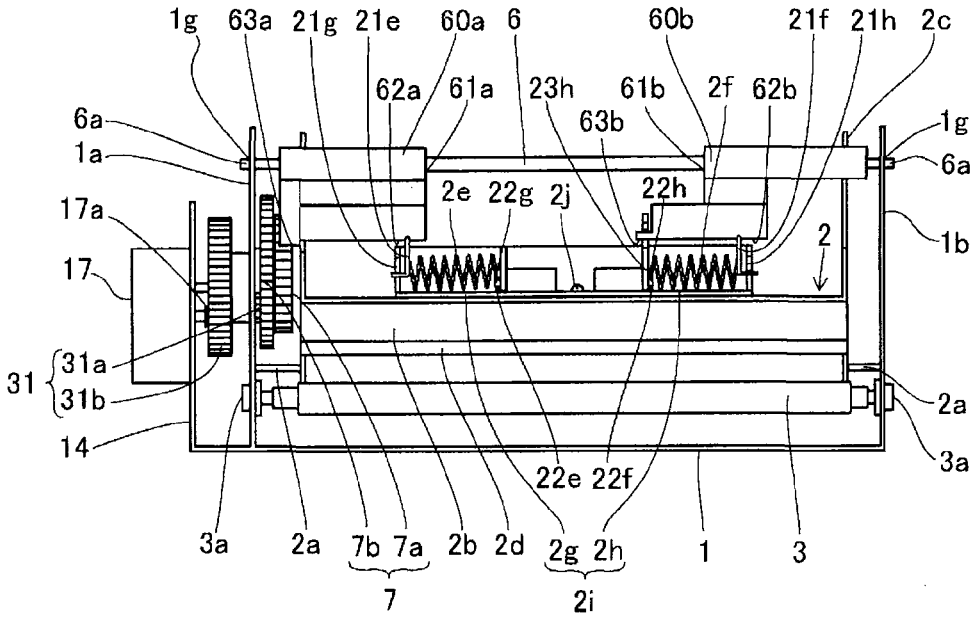
FIG. 8 is a front elevational view of the thermal transfer printer according to the embodiment of the present invention shown in FIG. 1.

As shown in FIG. 8, first and second support portions 6*a* are provided on first and second ends of the support rod 6 respectively. The first and second support portions 6*a* are fitted into the support holes 1*g* provided on the first and second side surfaces 1*a* and 1*b* of the chassis 1 respectively. First and second head portion pressing members 60*a* and 60*b* are mounted on the first and second ends of the support rod 6 respectively in an unidling manner with respect to the support rod 6. The first and second head portion pressing members 60*a* and 60*b* are provided with D-shaped receiving holes 61*a* and 61*b* receiving D-shaped insertional portions (not shown) provided in the vicinity of both ends of the support rod 6 respectively. Upon rotation of the first head portion pressing member 60*a*, therefore, the support rod 6 is rotated, followed by rotation of the second head portion pressing member 60*b*. The first and second head portion pressing members 60*a* and 60*b* are arranged on the sides of the first and second side surfaces 1*a* and 1*b* of the chassis 1 respectively, as shown in FIGS. 1 and 8. The first and second head portion pressing members 60*a* and 60*b* are examples of the "pressing member" in the present invention.

Figure 10:
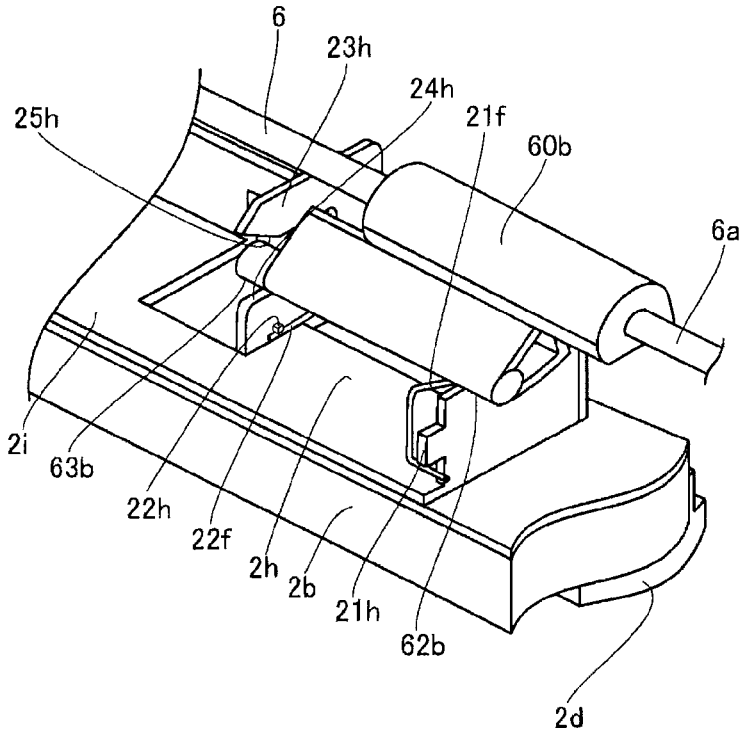
Figure 11:
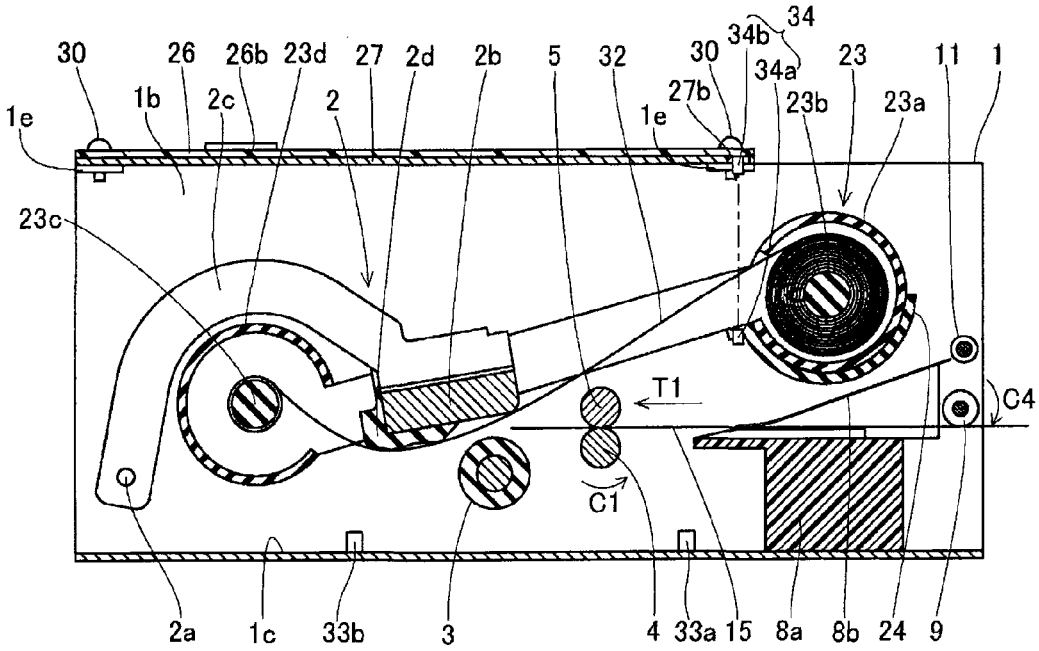
FIGS. 11 and 12 are sectional views for illustrating a printing operation of the thermal transfer printer according to the embodiment of the present invention shown in FIG. 1.

As shown in FIGS. 1 and 8, a pressing portion 62*a* and a gear portion 63*a* are integrally formed on the first head portion pressing member 60*a*. As shown in FIG. 10, a pressing portion 62*b* and a protrusion 63*b* protruding from the pressing portion 62*b* in the extensional direction of the support rod 6 are integrally formed on the second head portion pressing member 60*b*.

Figure 9:
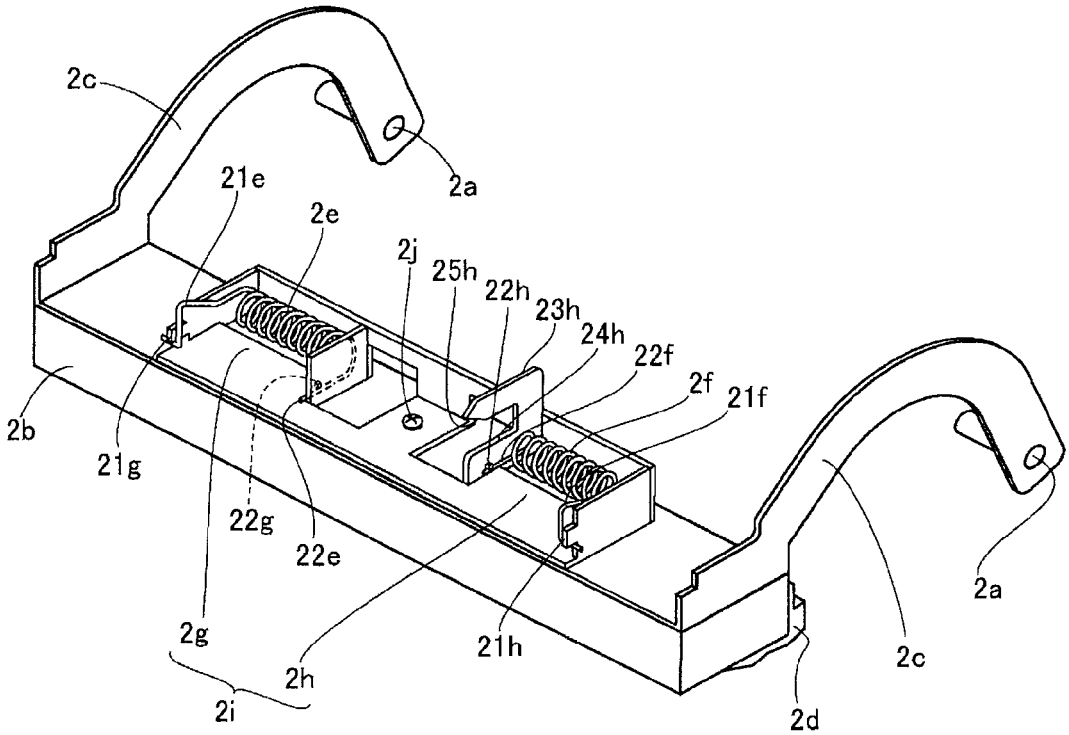
FIGS. 9 and 10 are perspective views showing the structure of a print head of the thermal transfer printer according to the embodiment of the present invention shown in FIG. 1.

As shown in FIG. 9, the print head 2 includes a pair of support shafts 2*a*, a head portion 2*b* opposed to the platen roller 3 (see FIGS. 1 and 2), a pair of arms 2*c* coupling the support shafts 2*a* and the head portion 2*b* with each other and a head cover 2*d* of resin mounted on the head portion 2*b*. This print head 2 is rendered rotatable about the support shafts 2*a*. In other words, the pair of support shafts 2*a* of the print head 2 are rotatably mounted on the first and second side surfaces 1*a* and 1*b* of the chassis 1 respectively.

In an upper part of the head portion 2*b*, first and second torsion coil springs 2*e* and 2*f* for urging the head portion 2*b* toward the platen roller 3 (see FIGS. 5 and 8) are arranged on regions corresponding to the first and second head portion pressing members 60*a* and 60*b* (see FIGS. 1 and 2) respectively. More specifically, a spring fixing member 2*i* consisting of first and second spring fixing portions 2*g* and 2*h* is mounted on the upper part of the head portion 2*b* through a screw 2*j*. The first and second spring fixing portions 2*g* and 2*h* of the spring fixing member 2*i* are arranged at a prescribed interval in the axial direction of the platen roller 3. The first and second torsion coil springs 2*e* and 2*f* are fixed to the first and second spring fixing portions 2*g* and 2*h* of the spring fixing member 2*i* respectively. The first spring fixing portion 2*g* of the spring fixing member 2*i* is provided with a stop portion 21*g* and a protrusion 22*g*, as shown in FIG. 9. The second spring fixing portion 2*h* of the spring fixing member 2*i* is also provided with a stop portion 21*h* and a protrusion 22*h*.

As shown in FIGS. 8 and 9, the first torsion coil spring 2*e* has a first end 21*e* pressed by the pressing portion 62*a* of the first head portion pressing member 60*a* upon downward rotation of the first head portion pressing member 60*a* and a second end 22*e* transmitting urging force resulting from the pressed first end 21*e* to the second head portion pressing member 60*b*. The second torsion coil spring 2*f* also has a first end 21*f* pressed by the pressing portion 62*b* of the second head portion pressing member 60*b* upon downward rotation of the second head portion pressing member 60*b* and a second end 22*f* transmitting urging force resulting from the pressed first end 21*f* to the head portion 2*b*. The head portion 2*b* is pressed against the platen roller 3 due to the urging force of the first and second torsion coil springs 2*e* and 2*f* transmitted thereto. The first end 21*e* of the first torsion coil spring 2*e* is stopped on the stop portion 21*g* of the spring fixing member 2*i*, while the second end 22*e* thereof is fixed to the protrusion 22*g* of the spring fixing member 2*i*. Further, the first end 21*f* of the second torsion coil spring 2*f* is stopped on the stop portion 21*h* of the spring fixing member 2*i*, while the second end 22*f* thereof is fixed to the protrusion of the spring fixing member 2*i*.

As shown in FIG. 10, an engaging portion 23*h* having a notch 24*h* engaging with the protrusion 63*b* of the second head portion pressing member 60*b* is integrally formed on the second spring fixing portion 2*h* of the spring fixing member 2*i*. When the second head portion pressing member 60*b* is rotated upward, therefore, the protrusion 63*b* of the second head portion pressing member 60*b* and the notch 24*h* of the second spring fixing portion 2*h* so engage with each other that the head portion 2*b* is also rotated upward. Consequently, the head portion 2*b* pressed against the platen roller 3 (see FIGS. 5 and 8) is separated from the platen roller 3 upon this rotation of the second head portion pressing member 60*b*. A chamfer 25*h* is formed on an opening side of the notch 24*h*, for facilitating engagement with the protrusion 63*b*.

As shown in FIGS. 1 and 8, the drive gear 7 and the intermediate gear 31 are so provided as to rotate the first and second head portion pressing members 60*a* and 60*b* by transmitting driving force of the stepping motor 17 thereto. The drive gear 7 and the intermediate gear 31 are mounted inside the first side surface 1*a* of the chassis 1. The stepping motor 17 is mounted on the first side surface 1*a* of the chassis 1 through the motor bracket 14. A small-diametral gear portion 7*a* of the drive gear 7 meshes with the gear portion 63*a* of the first head portion pressing member 60*a*, while a large-diametral gear portion 7*b* of the drive gear 7 meshes with a small-diametral gear 31*a* of the intermediate gear 31. A large-diametral gear 31*b* of the intermediate gear 31 meshes with a motor gear 17*a* of the stepping motor 17. Thus, the driving force of the stepping motor 17 is transmitted to the first head portion pressing member 60*a* through the intermediate gear 31 and the drive gear 7.

Figure 7:
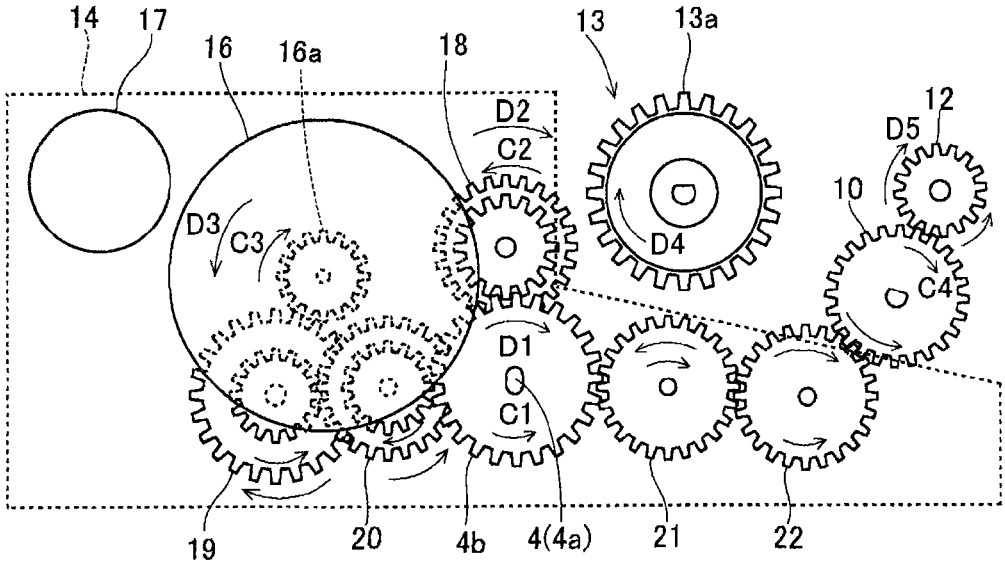
FIG. 7 illustrates arrangement of gears included in the thermal transfer printer according to the embodiment of the present invention shown in FIG. 1.

As shown in FIG. 7, a motor gear 16*a* is mounted on a shaft portion of the stepping motor 16 mounted on the motor bracket 14. The stepping motor 16 functions as a driving source for driving a gear portion 13*a* of the ink sheet take-up reel 13, the paper feed roller gear 10, the paper discharge roller gear 12 and the feed roller gear 4*b*.

As shown in FIG. 5, the lower paper guide 8*a* is set in the vicinity of the feed roller 4 and the press roller 5. The upper paper guide 8*b* is mounted on an upper part of the lower paper guide 8*a*, as shown in FIG. 5. This upper paper guide 8*b* has a function of guiding each paper 15 to a paper feed passage toward a printing portion through the lower surface thereof in paper feeding while guiding the same to a paper discharge passage through the upper surface thereof in paper discharge.

The ink sheet cartridge support portion 24 is arranged inside the first and second side surfaces 1*a* and 1*b* of the chassis 1, as shown in FIGS. 1 and 6. A photoreceptive portion 34*a* of a transmission-type ink sheet search sensor 34 is mounted on the ink sheet cartridge support portion 24, as shown in FIG. 5. A light-emitting portion 34*b* of the ink sheet search sensor 34 is mounted on the wiring board 26, to be opposed to the photoreceptive portion 34*a* through the ink sheet 32. The ink sheet search sensor 34 is so provided as to search for the ink sheet 32 by detecting each color search identification portion 32*e* (see FIG. 4) and each ink sheet search identification portion 32*f* (see FIG. 4) of the ink sheet 32 arranged between the photoreceptive portion 34*a* and the light-emitting portion 34*b* as described later. According to this embodiment, the ink sheet search sensor 34 is also employed for sensing the rear end of the ink sheet 32 serving as a starting point for an operation of cleaning the head portion 2*b* described later. The ink sheet search sensor 34 is an example of the "ink sheet sensor" in the present invention.

The wiring board 26 is mounted on the mounting portions 1*e* of the chassis 1 through the top plate 27, as shown in FIG. 1. More specifically, the wiring board 26 is fixed by fastening the four screws 30 passing through four holes 26*a* of the wiring board 26 and four holes 27*a* of the top plate 27 to the threaded holes 1*f* of the mounting portions 1*e* of the chassis 1 respectively. Electronic components 26*b* constituting the circuit portion 25 and the aforementioned light-emitting portion 34*b* of the ink sheet search sensor 34 are mounted on the wiring board 26. The top plate 27 is provided with a hole 27*b* for exposing the light-emitting portion 34*b* constituting the ink sheet search sensor 34 mounted on the wiring board 26 toward the chassis 1.

Figure 3:
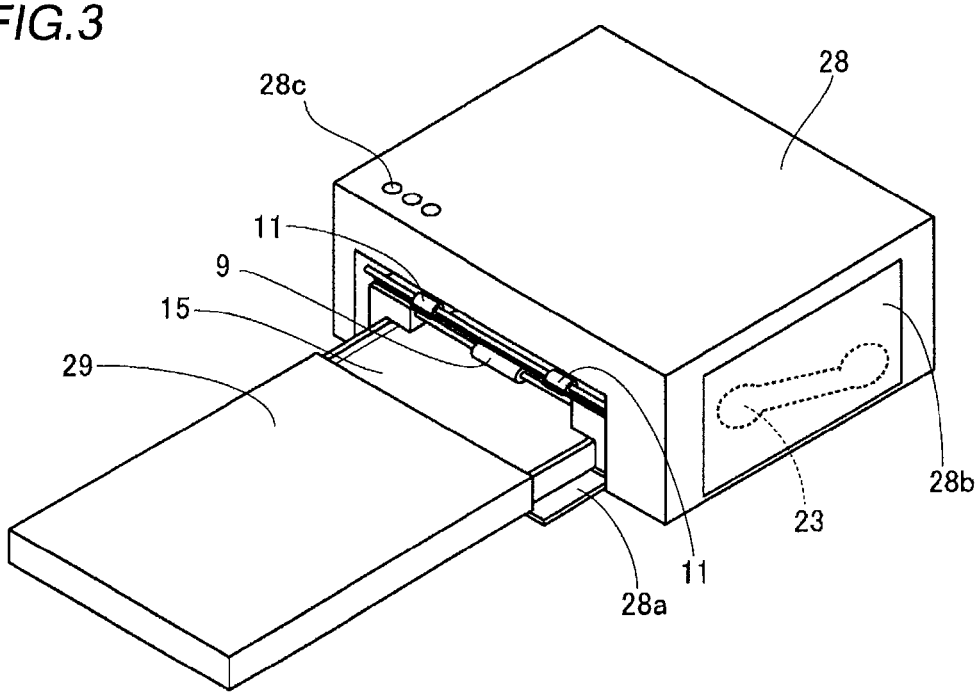
FIG. 3 is a perspective view of the thermal transfer printer according to the embodiment of the present invention shown in FIG. 1.

As shown in FIG. 3, the housing 28 includes lid members 28*a* and 28*b* and LEDs (light-emitting diodes) 28*c*. The lid member 28*a* of the housing 28 is so provided as to mount the paper feed cassette case 29 on the thermal transfer printer. The lid member 28*b* of the housing 28 is so provided as to mount the ink sheet cartridge 23 on the thermal transfer printer. The LEDs 28*c* are blinked after completion of the cleaning operation described later upon arrival of the rear end of the ink sheet 32, for serving as an alarm portion prompting the user to exchange the ink sheet cartridge 23. The LEDs 28*c* are examples of the "light-emitting device portion" in the present invention.

As shown in FIG. 5, the ink sheet cartridge 23 is provided with a supply portion 23*d*, in which a supply bobbin 23*c* wound with the ink sheet 32 is rotatably arranged. The ink sheet 32 has 20 sets of three types of color sheets including color Y (yellow) printing sheets 32*a*, color M (magenta) printing sheets 32*b* and color C (cyan) printing sheets 32*c* as well as transparent OP (overcoat) sheets 32*d* for protecting printed surfaces of the papers 15 respectively. In other words, the thermal transfer printer can perform printing on 20 papers 15 with this ink sheet cartridge 23.

The color search identification portions 32*f* are provided on the boundaries between the color Y (yellow), color M (magenta) and color C (cyan) printing sheets 32*a*, 32*b* and 32*c* and the OP (overcoat) sheets 32*d* respectively. Each color search identification portion 32*e* is formed by a light blocking portion, and has a length of about 5 mm along a printing direction. Each color search identification portion 32*e* is detected by the ink sheet search sensor 34, so that the corresponding one of the color Y (yellow), color M (magenta) and color C (cyan) printing sheets 32*a*, 32*b* and 32*c* and the OP (overcoat) sheets 32*d* is carried to a printing start position for the corresponding sheet 32*a*, 32*b*, 32*c* or 32*d*.

Figure 4:
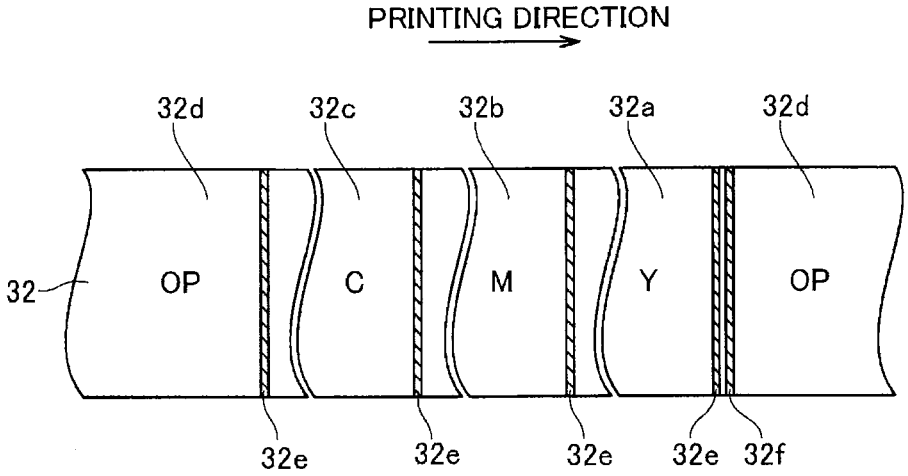
FIG. 4 is a diagram for illustrating an ink sheet of the thermal transfer printer according to the embodiment of the present invention shown in FIG. 1.

Each ink sheet identification portion 32*f* is provided on a portion, closer to the OP (overcoat) sheet 32*d*, of the boundary between each OP (overcoat) sheet 32*d* and each color Y (yellow) printing sheet 32*a*. Each ink sheet identification portion 32*f* is formed by a light blocking portion, and has a length of about 5 mm along the printing direction. Each ink sheet identification portion 32*f* is so provided that the ink sheet 32 is carried to a printing start position when the same and the color search identification portion 32*e* provided on the head of each color Y (yellow) printing sheet 32*a* are detected by the ink sheet search sensor 34. As shown in FIG. 4, a region located between each ink sheet search identification portion 32*f* and the rear end of each OP (overcoat) sheet 32*d* through each color Y (yellow) printing sheet 32*a*, each color M (magenta) printing sheet 32*b* and each color C (cyan) printing sheet 32*c* constitutes a prescribed region necessary for performing printing on each paper 15.

Figure 2:
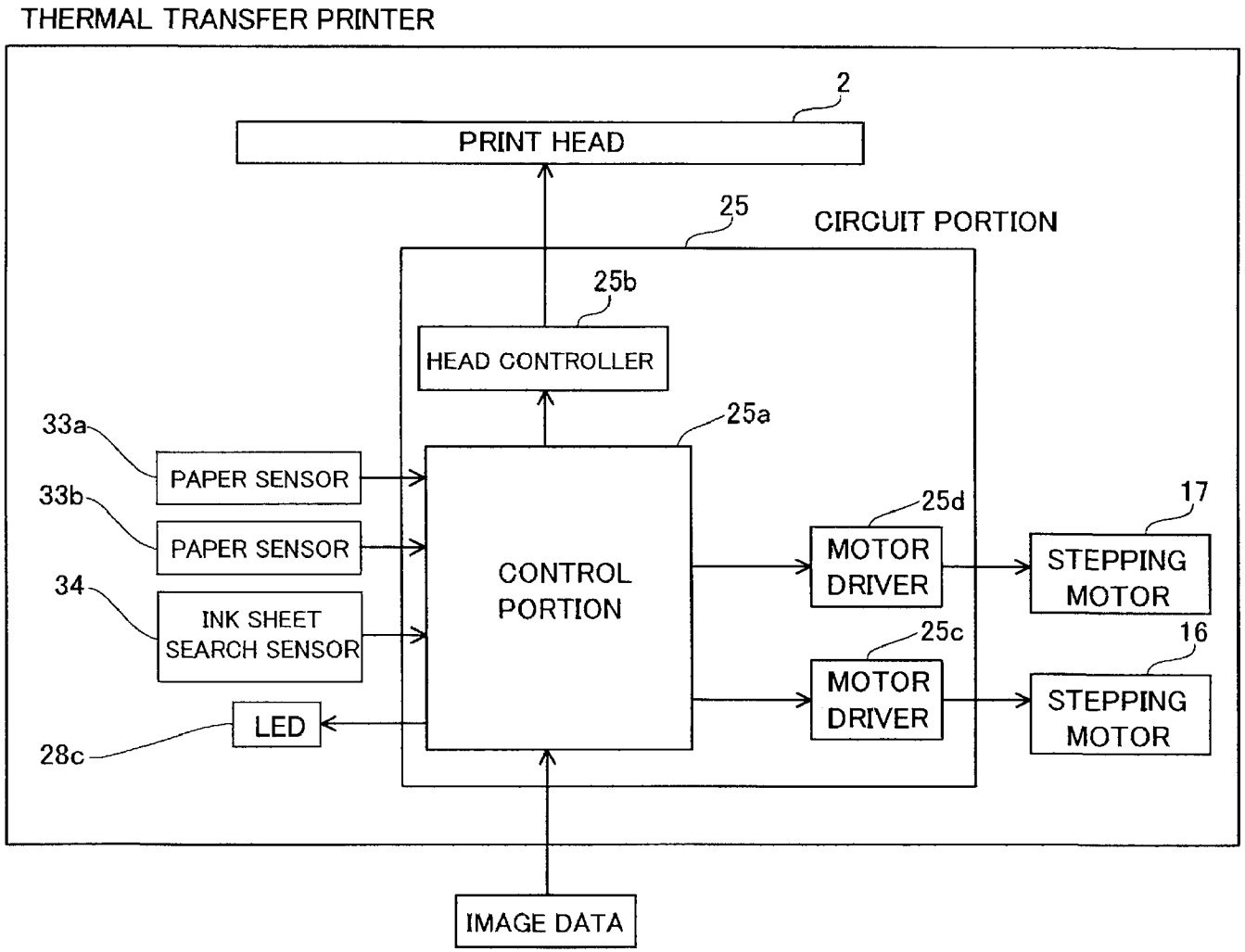
FIG. 2 is a block diagram showing the circuit structure of the thermal transfer printer according to the embodiment of the present invention shown in FIG. 1.

As shown in FIG. 2, the circuit portion 25 includes a control portion 25*a*, a head controller 25*b* controlling the temperature of a heating element of the print head 2 and two motor drivers 25*c* an 25*d*. The control portion 25*a* has a function of controlling the overall printing operation. The head controller 25*b* has a function of controlling the temperature of the heating element of the print head 2 by applying a voltage pulse thereto. The motor drivers 25*c* and 25*d* have functions of controlling rotation of the stepping motors 16 and 17 by applying voltage pulses thereto respectively.

According to this embodiment, the control portion 25*a* of the circuit portion 25 has another function of cleaning the head portion 2*b* by determining arrival of the rear end of the ink sheet 32 if the ink sheet search sensor 34 can sense no ink sheet search identification portion 32*f* of the ink sheet 32 when the ink sheet 32 is carried by a prescribed length (corresponding to the length of each color Y (yellow) printing sheet 32*a*, for example) and driving the stepping motor 17 by controlling the motor driver 25*d* on the basis of this determination thereby rotating the first and second head portion pressing members 60*a* and 60*b*.

The printing operation and the cleaning operation of the thermal transfer printer according to the embodiment of the present invention are now described with reference to FIGS. 1, 2, 5, 7 and 11 to 18.

Figure 13:
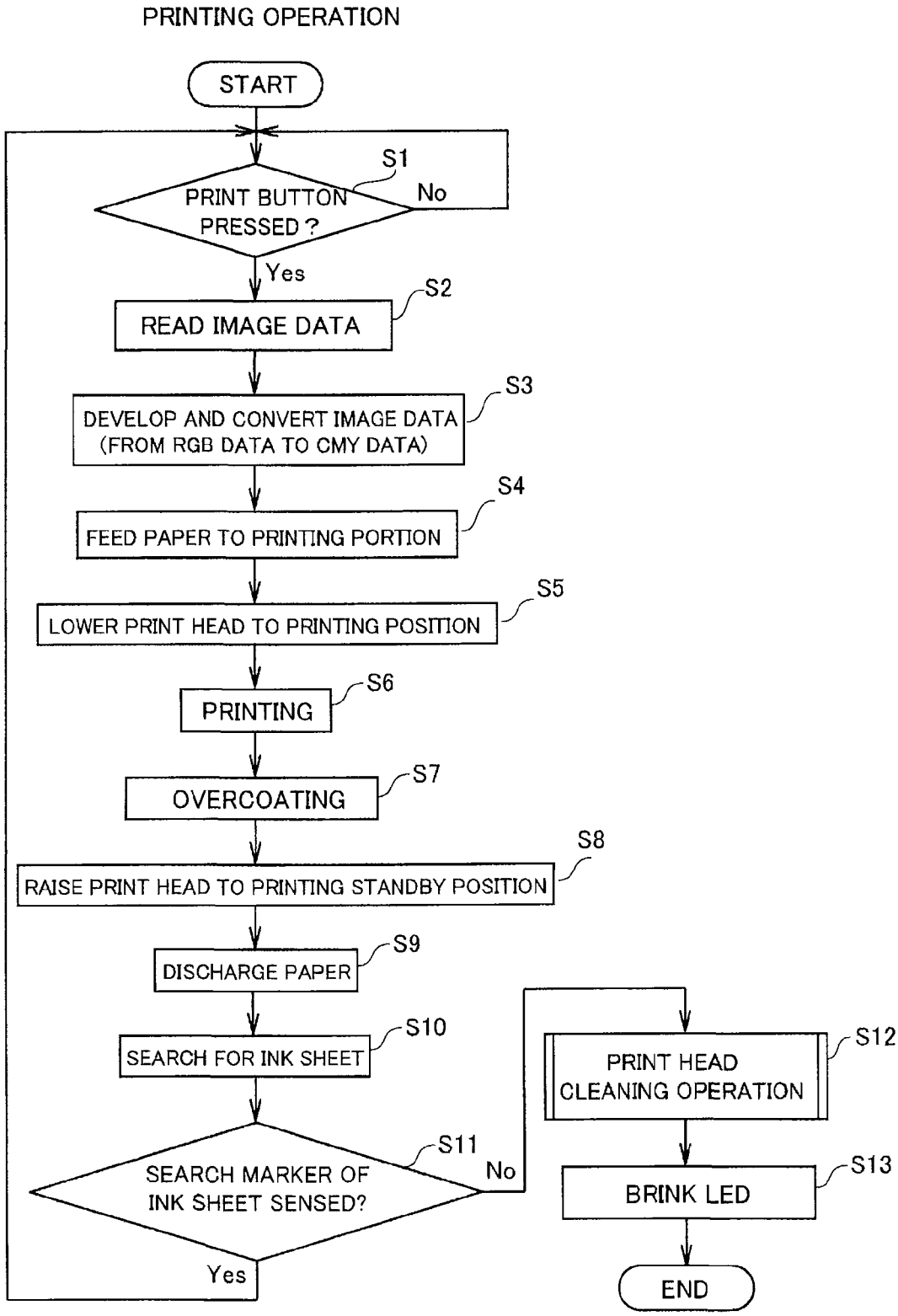
FIG. 13 is a flow chart for illustrating the printing operation and a cleaning operation of the thermal transfer printer according to the embodiment of the present invention shown in FIG. 1.

At a step S1 shown in FIG. 13, the control portion 25*a* determines whether or not a print button (not shown) has been pressed, and repeats the step S1 until the print button is pressed if the determination is of NO. If the determination at the step S1 is of YES, on the other hand, the control portion 25*a* (see FIG. 2) reads image data at a step S2. At a step S3, the control portion 25*a* (see FIG. 2) converts the read image data from RGB data to CMY data. The three primary colors of light (R (red), G (green) and B (blue)) constitute the RGB data, while the three primary colors of object color (C (cyan), M (magenta) and Y (yellow)) constitute the CMY data.

At a step S4, the control portion 25*a* carries each paper 15 from the paper feed cassette case 29 (see FIG. 1) toward the printing start position, and determines whether or not this paper 15 has reached the printing start position. In other words, the paper sensors 33*a* and 33*b* for detecting the front and rear ends of the paper 15 search for the paper 15. In paper feeding, the stepping motor 16 is so driven as to rotate the motor gear 16*a* mounted thereon along arrow C3 in FIG. 7 thereby rotating the feed roller gear 4*b* along arrow C1 in FIG. 7 through the intermediate gears 19 and 20, as shown in FIG. 7. Thus, the feed roller 4 is rotated along arrow C1 in FIGS. 5 and 7. Further, the paper feed roller gear 10 and the paper feed roller 9 are rotated along arrow C4 in FIGS. 7 and 11 through the intermediate gears 21 and 22. Thus, the paper 15 is carried in the paper feed direction (along arrow T1 in FIG. 11). At this time, the swingable swing gear 18 is not in mesh with the gear 13*a* of the take-up reel 13, whereby the gear 13*a* remains unrotational. In paper feeding, therefore, the ink sheet 32 wound on a take-up bobbin 23*b* and the supply bobbin 23*c* is not taken up.

Figure 12:
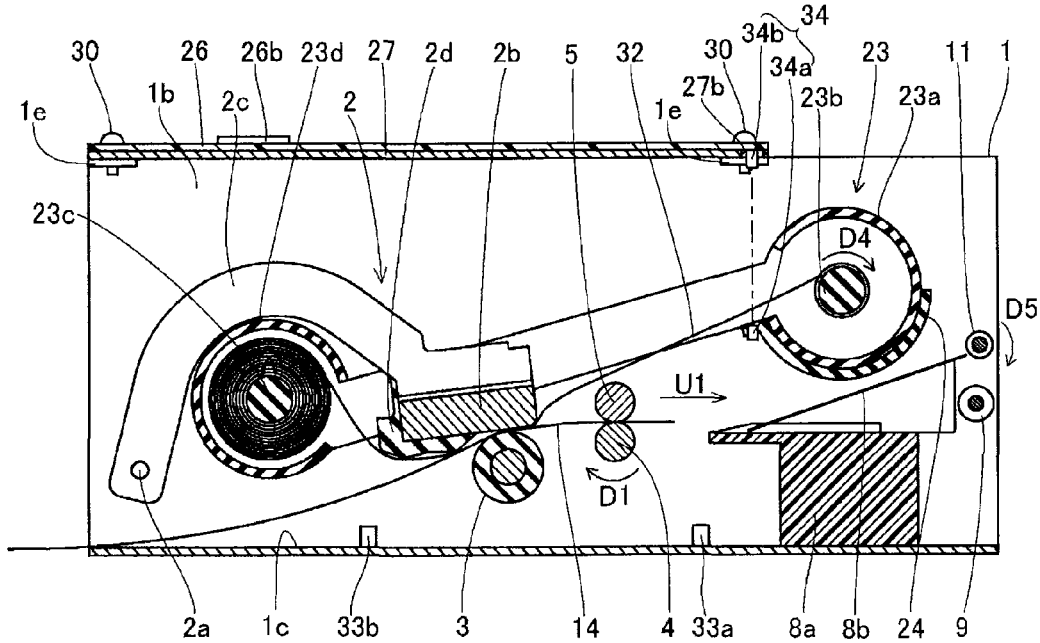

At a step S5, the control portion 25*a* lowers the print head 2 to a printing position (see FIG. 12). This operation of lowering the print head 2 is described later in more detail. At a step S6, the control portion 25*a* carries the paper 15 in a paper discharge direction (along arrow U1) so that the print head 2 and the platen roller 3 press the paper 15 and each color Y (yellow) printing sheet 32*a* against each other and the head portion 2*b* of the print head 2 generates heat. The head portion 2*b* so generates heat as to sublimate ink of the color Y (yellow) printing sheet 32*a* for transferring this ink to the paper 15 thereby performing printing. In this printing operation, the stepping motor 16 is so driven as to rotate the motor gear 16*a* mounted thereon along arrow D3 in FIG. 7 thereby rotating the feed roller gear 4*b* along arrow D1 in FIG. 7 through the intermediate gears 19 and 20, as shown in FIG. 7. Thus, the feed roller 4 is rotated along arrow D1 in FIGS. 5 and 7. Further, the paper discharge roller gear 12 and the paper discharge roller 11 are rotated along arrow D5 in FIGS. 7 and 11 through the intermediate gears 21 and 22 and the paper feed roller gear 10. Thus, the paper 15 is carried in the printing direction (along arrow U1 in FIG. 12). At this time, the swingable swing gear 18 meshes with the gear 13*a* of the take-up reel 13, thereby rotating the gear 13*a* along arrow D4 in FIGS. 7 and 12. Therefore, the take-up bobbin 23*c* engaging with the take-up reel 13 is also rotated along arrow D4 in FIGS. 7 and 12, thereby taking up the ink sheet 32 wound on the take-up bobbin 23*b* and the supply bobbin 23*c*. Thus, the paper 15 is carried along arrow U1 in FIG. 12 and the ink sheet 32 is taken up in the printing operation, so that the ink is transferred from the ink sheet 32 to the paper 15.

After the ink is transferred from each color Y (yellow) printing sheet 32*a* as described above, the paper 15 is carried in the paper feed direction and returned to the printing start position, and thereafter carried in the paper discharge direction (along arrow U1) to be subjected to printing in the color M (magenta) and the color C (cyan) in a similar manner to the above. Thereafter the control portion 25*a* performs overcoating at a step S7, and raises the print head 2 to a printing standby position (see FIG. 11) at a step S8. The printing standby position is an example of the "first nonprinting position" in the present invention. This operation of raising the print head 2 is described later in more detail.

At a step S9, the control portion 25*a* discharges the paper 15 from the thermal transfer printer. In this operation of discharging the paper 15, the control portion 25*a* carries the paper 15 along arrow U1 in FIG. 12 thereby discharging the same, similarly to the aforementioned operation of carrying the paper 15 in printing.

In order to prepare for subsequent printing, the control portion 25*a* searches for the subsequent color Y (yellow) printing sheet 32*a*. In other words, the control portion 25*a* takes up the ink sheet 32 until the ink sheet search sensor 34 recognizes the corresponding ink sheet search identification portion 32*f* (see FIG. 4), as shown in FIG. 5. The control portion 25*a* takes up the ink sheet 32 similarly to the aforementioned take-up operation in printing. If the control portion 25*a* determines that the ink sheet search sensor 34 recognizes the ink sheet search identification portion 32*f* (see FIG. 4) at a step S11, the process returns to the step S1 and the control portion 25*a* waits for a subsequent printing instruction. If the determination at the step S11 is of NO, on the other hand, the control portion 25*a* determines arrival of the rear end of the ink sheet 32, and the process advances to a step S12. At the step S12, the control portion 25*a* cleans the print head 2.

Figure 14:
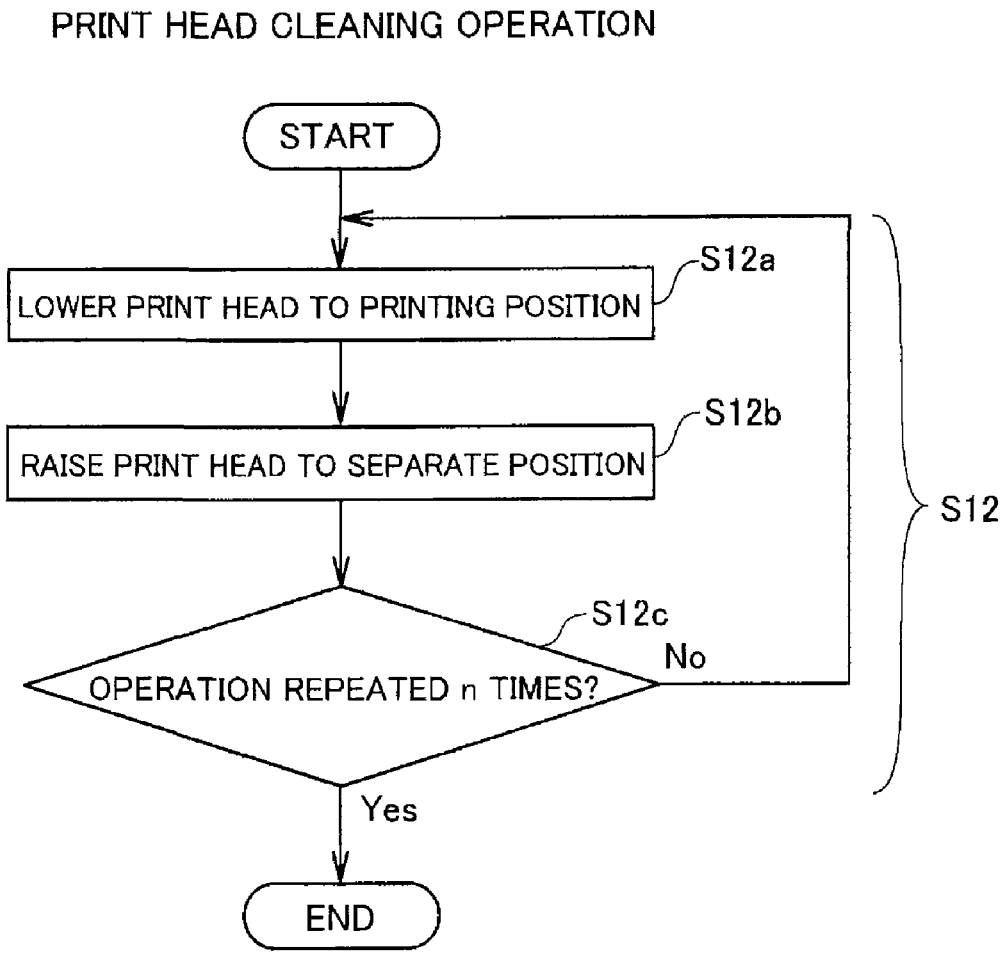
FIG. 14 is a flow chart for illustrating the cleaning operation of the thermal transfer printer according to the embodiment of the present invention shown in FIG. 1.

In this cleaning operation, the control portion 25*a* rotates the print head 2 for lowering the same to the printing position (see FIG. 16) at a step S12*a* shown in FIG. 14. In this operation, identical to the operation at the step S5 in printing shown in FIG. 13, the control portion 25*a* presses the print head 2, having been separated from the platen roller 3, against the platen roller 3. The operation of lowering the print head 2 is now described in detail with reference to FIGS. 15 to 18.

Figure 17:
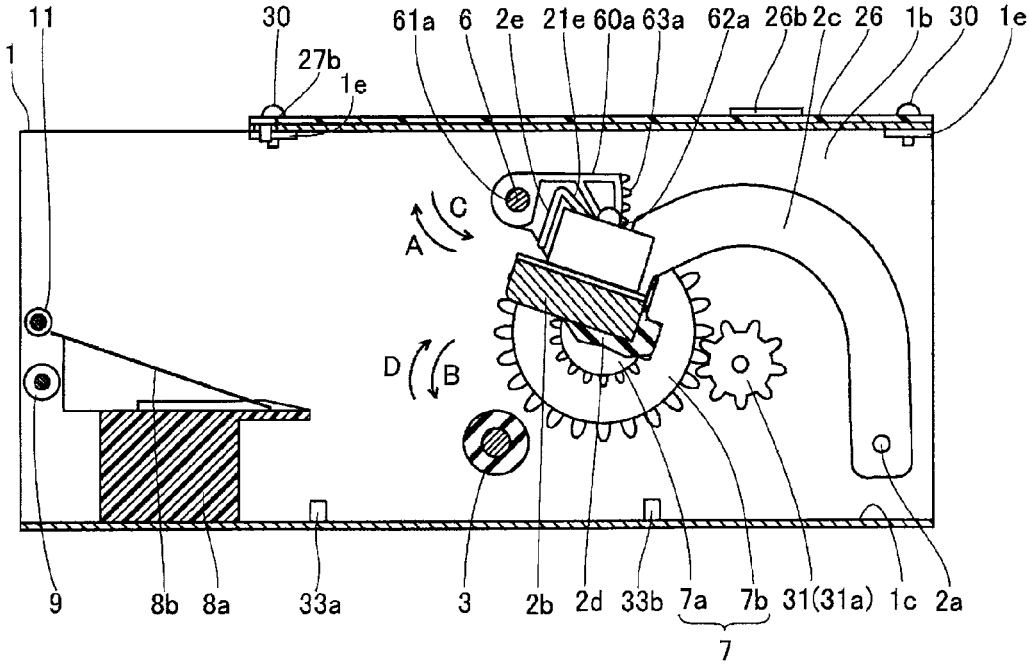
FIGS. 17 and 18 are sectional views for illustrating an operation of separating the print head from the platen roller in the thermal transfer printer according to the embodiment of the present invention shown in FIG. 1.
Figure 18:
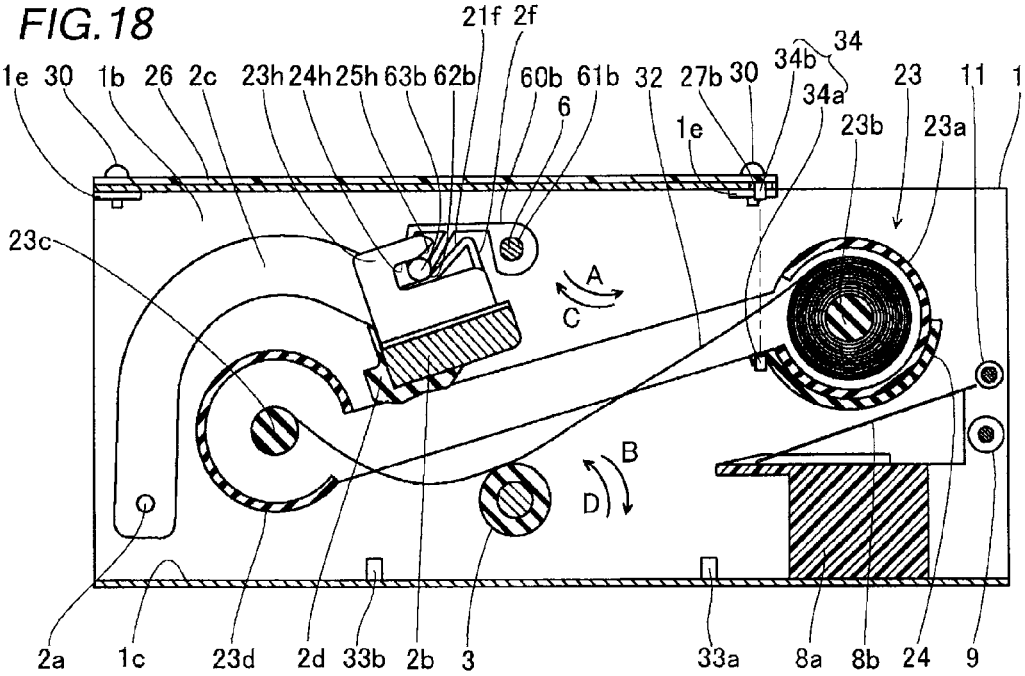

As shown in FIGS. 17 and 18, the head portion 2*b* of the print head 2 is held at a separate position with respect to the platen roller 3. This separate position is higher than the printing standby position shown in FIG. 11. The separate position is an example of the "second nonprinting position" in the present invention. On this separate position, the protrusion 63*b* of the second head portion pressing member 60*b* engages with the notch 24*h* of the engaging portion 23*h* of the second spring fixing portion 2*h* provided on the upper part of the head portion 2*b* as shown in FIG. 18, thereby regulating rotation of the head portion 2*b* along arrow B in FIG. 18.

From the state shown in FIGS. 17 and 18, the control portion 25*a* rotates/drives the stepping motor 17 (see FIG. 6) in a prescribed direction through the motor driver 25*d*, thereby transmitting the driving force of the stepping motor 17 to the gear portion 63*a* of the first head portion pressing member 60*a* through the intermediate gear 31 and the drive gear 7. Thus, the first head portion pressing member 60*a* is rotated along arrow A about the support rod 6. At this time, the first and second head portion pressing members 60*a* and 60*b* (see FIG. 8) remain unidling with respect to the support rod 6, whereby the second head portion pressing member 60*b* is also rotated along arrow A. The protrusion 63*b* of the second head portion pressing member 60*b* is also rotated along arrow A, for rotating the head portion 2*b*, having been inhibited from rotation along arrow B by the protrusion 63*b*, along arrow B. In this state moving the print head 2 to the position where the same is pressed, the first and second head portion pressing members 60*a* and 60*b* are further rotated along arrow A. Thus, the pressing portion 62*a* of the first head portion pressing member 62*a* presses the first end 21*e* of the first torsion coil spring 2*e* of the print head 2. Further, the pressing portion 62*b* of the second head portion pressing member 60*b* presses the first end 21*f* of the second torsion coil spring 2*f* of the print head 2. At this time, the first and second torsion coil springs 2*e* and 2*f* generate urging force, which in turn is transmitted to the head portion 2*b* through the second ends 22*e* and 22*f* of the first and second torsion coil springs 2*e* and 2*f*. Therefore, the head portion 2*b* is urged toward the platen roller 3. Thus, the head portion 2*b* is moved toward the platen roller 3 (the side where the head portion 2*b* is pressed) and the print head 2 is lowered to the printing position (see FIG. 16), as shown in FIGS. 15 and 16.

At a step S12*b*, the control portion 25*a* rotates the print head 2 for raising the same from the printing position (see FIG. 16) to the separate position (see FIG. 18). This operation of raising the print head 2 to the separate position is similar to the operation of raising the print head 2 to the printing standby position at the step S8 shown in FIG. 13 except the position where the print head 2 is raised. In other words, the control portion 25*a* separates the print head 2, having been pressed against the platen roller 3, from the platen roller 3. The operation of raising the print head 2 to the separate position is now described in detail with reference to FIGS. 15 to 18.

Figure 15:
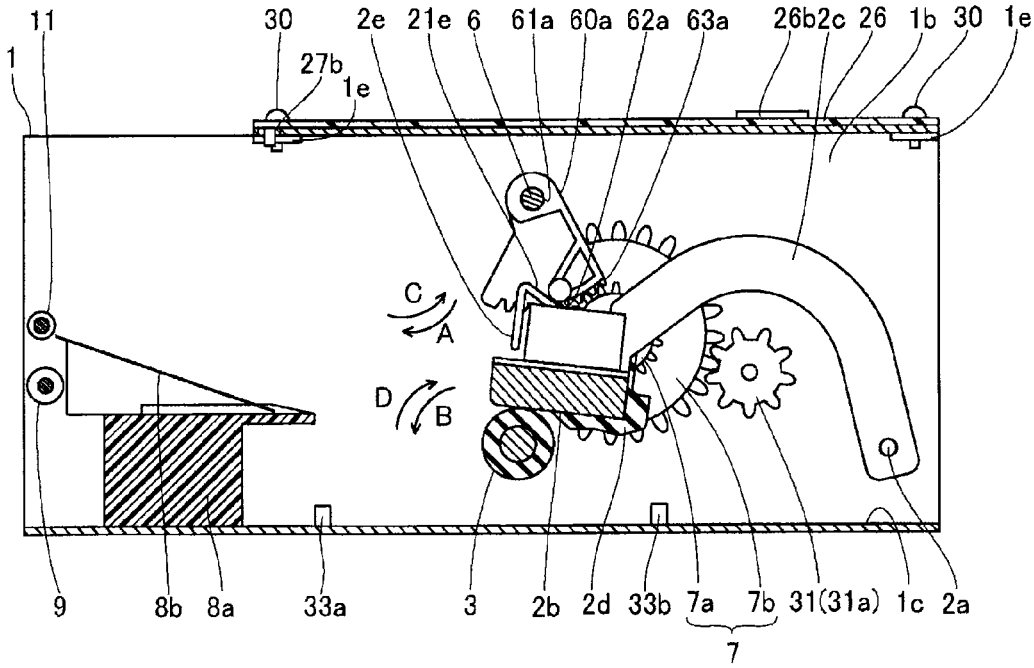
FIGS. 15 and 16 are sectional views for illustrating an operation of pressing the print head against a platen roller in the thermal transfer printer according to the embodiment of the present invention shown in FIG. 1.
Figure 16:
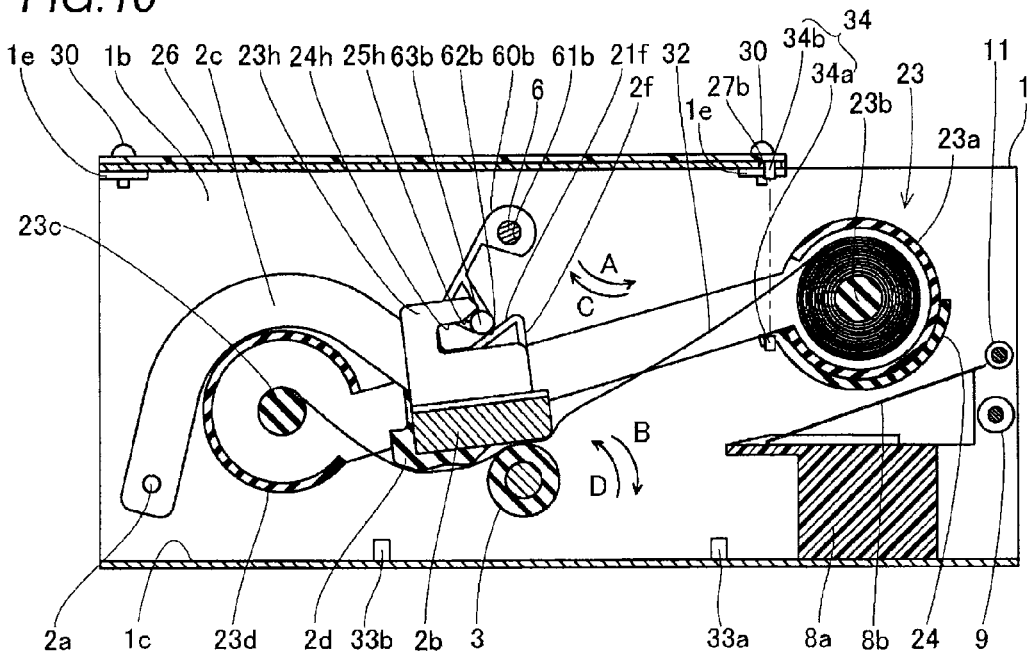

In the state pressed against the platen roller 3, the head portion 2*b* of the print head 2 is urged toward the platen roller 3, as shown in FIGS. 15 and 16. From the state shown in FIG. 15, the control portion 25*a* (see FIG. 2) rotates/drives the stepping motor 17 (see FIG. 6) oppositely to the prescribed direction through the motor driver 25*d*, thereby transmitting the driving force of the stepping motor 17 to the gear portion 63*a* of the first head portion pressing member 60*a* through the intermediate gear 31 and the drive gear 7. Thus, the first head portion pressing member 60*a* is rotated along arrow C in FIG. 15 about the support rod 6. At this time, the first and second head portion pressing members 60*a* and 60*b* (see FIG. 8) remain unidling with respect to the support rod 6, whereby the second head portion pressing member 60*b* is also rotated along arrow C in FIG. 16, as shown in FIG. 16. Thus, the head portion 2*b* is released from the urging force resulting from the first and second torsion coil springs 2*e* and 2*f* of the head portion 2*b* having been pressed by the first and second head portion pressing members 60*a* and 60*b*. Then, the protrusion 63*b* of the second head portion pressing member 60*b* engages with the notch 24*h* of the engaging portion 23*h* of the second spring fixing portion 2*h* of the spring fixing member 2*i* mounted on the head portion 2*b*.

When the first and second head portion pressing members 60*a* and 60*b* are further rotated along arrow C in FIG. 16, the print head 2 is also raised and rotated along arrow D due to the engagement between the protrusion 63*b* of the second head portion pressing member 60*b* and the notch 24*h* of the engaging portion 23*h* of the spring fixing member 2*i* mounted on the head portion 2*b*, as shown in FIG. 18. Thus, the head portion 2*b* is separated from the platen roller 3. At this time, the print head 2 is raised from the printing position (see FIG. 16) where the same is urged toward the platen roller 3 to the separate position (see FIG. 18) higher than the printing standby position in the cleaning operation according to this embodiment. The control portion 25*a* cleans the head portion 2*b* by dropping dust (foreign matter) adhering to the surface of the head portion 2*b* onto the ink sheet 32 when lowering the print head 2 at the step S12*a* and raising the same at the step S12*b*.

At the step S12*b*, the control portion 25*a* controls the stepping motor 17 (motor driver 25*d*) so that the rotational speed for raising the print head 2 to the separate position (see FIG. 18) is higher than that for rotating the print head 2 from the printing position (see FIG. 16) to the printing standby position (see FIG. 11) in printing at the step S8 shown in FIG. 13.

At a step S12*c*, the control portion 25*a* (see FIG. 2) determines whether or not the aforementioned rotating operation has been repeated n times (three times, for example). If the determination at the step S12*c* is of NO, the control portion 25*a* repeats the operations through the steps S12*a* to S12*c*. If the determination at the step S12*c* is of YES, on the other hand, the control portion 25*a* terminates the cleaning operation at the step S12.

At a step S13 shown in FIG. 13, the control portion 25*a* (see FIG. 2) blinks the LEDs 28*c* of the housing 28, for posting the user that the ink sheet 32 is used up and hence the ink sheet cartridge 23 must be exchanged.

According to this embodiment, as hereinabove described, the thermal transfer printer cleans the print head 2 by rotating the same between the printing position (see FIG. 16) and the separate position (see FIG. 18) for dropping foreign matter adhering to the print head 2 onto the ink sheet 32 when sensing arrival of the rear end of the ink sheet 32. Thus, the thermal transfer printer can clean the print head 2 simply through an additional operation similar to the operation of rotating the print head 2 in printing with no requirement for any additional structure. Further, the thermal transfer printer, cleaning the print head 2 by dropping the foreign matter onto the ink sheet 32, can also drop thermally infusible foreign matter for removing the same. The thermal transfer printer drops the foreign matter onto the ink sheet 32 for discharging the same along with the ink sheet cartridge 23 when the ink sheet cartridge 23 is exchanged, whereby the foreign matter can be prevented from remaining in the thermal transfer printer.

According to this embodiment, the print head 2 is brought into contact with the ink sheet 32 when rotated to the printing position in cleaning of the print head 2, whereby the print head 2 is so brought into contact with the ink sheet 32 in cleaning that the thermal transfer printer can transfer the foreign matter from the print head 2 onto the surface of the ink sheet 32 in addition to the function of dropping the same onto the ink sheet 32.

According to this embodiment, the thermal transfer printer performs at least the operation of rotating the print head 2 from the printing position (see FIG. 16) to the separate position (see FIG. 18) in cleaning at the rotational speed higher than that for rotating the print head 2 in printing. Thus, the thermal transfer printer, capable of reliably separating the foreign matter from the print head 2 and dropping the same onto the ink sheet 32, can more reliably clean the print head 2. Consequently, the thermal transfer printer can be improved in cleaning ability.

According to this embodiment, the thermal transfer printer cleans the print head 2 by rotating the same between the printing position (see FIG. 16) and the printing standby position (see FIG. 11) where the print head 2 is arranged when the ink sheet search sensor 34 searches for the ink sheet 32 in printing, whereby the rotational range of the print head 2 can be so enlarged that the thermal transfer printer can more reliably remove the foreign matter. Thus, the thermal transfer printer can be further improved in cleaning ability.

According to this embodiment, the thermal transfer printer cleans the print head 2 by rotating the same between the printing position (see FIG. 16) and the separate position (see FIG. 18) a plurality of times, whereby the thermal transfer printer, rotating the print head 2 a plurality of times, can more reliably remove the foreign matter. Thus, the thermal transfer printer can be further improved in cleaning ability.

According to this embodiment, the thermal transfer printer senses arrival of the rear end of the ink sheet 32 and cleans the print head 2 when the ink sheet search sensor 34 for searching for the ink sheet 32 by sensing each prescribed region of the ink sheet 32 no longer senses any ink sheet search identification portion 32*f*, whereby the thermal transfer printer, capable of sensing arrival of the rear end of the ink sheet 32 with the existing ink sheet search sensor 34, can clean the print head 2 with no requirement for any additional structure.

According to this embodiment, the ink sheet 32 includes the ink sheet search identification portions 32*f* provided on the prescribed region so that the thermal transfer printer senses arrival of the rear end of the ink sheet 32 if the ink sheet search sensor 34 no longer senses any ink sheet search identification portion 32*f* when the ink sheet 32 is carried by the prescribed length, whereby the thermal transfer printer can easily sense arrival of the rear end of the ink sheet 32 through the ink sheet search identification portions 32*f* and the ink sheet search sensor 34.

According to this embodiment, the alarm portion is provided for prompting the user to exchange the ink sheet cartridge 23 after completely cleaning the print head 2 so that the thermal transfer printer can prompt the user to exchange the ink sheet cartridge 23 with the alarm portion when completely cleaning the print head 2, thereby reliably discharging the foreign matter adhering to the print head 2 along with the used ink sheet cartridge 23.

According to this embodiment, the alarm portion includes the LEDs 28*c*, whereby the thermal transfer printer can more reliably prompt the user to exchange the ink sheet cartridge 23 by blinking the LEDs 28*c* after completely cleaning the print head 2.

According to this embodiment, the thermal transfer printer, provided with the first and second rotatable head portion pressing members 60*a* and 60*b* pressing the print head 2 against the platen roller 3 for rotating the first and second head portion pressing members 60*a* and 60*b* thereby rotating the print head 2 between the printing position and the separate position, can press and rotate the horizontally long print head 2 having the prescribed printing width in the longitudinal direction with the first and second head portion pressing members 60*a* and 60*b*, for more reliably rotating the print head 2.

Although the present invention has been described and illustrated in detail, it is clearly understood that the same is by way of illustration and example only and is not to be taken by way of limitation, the spirit and scope of the present invention being limited only by the terms of the appended claims.

For example, while the aforementioned embodiment is applied to the thermal transfer printer employed as an exemplary image generating apparatus, the present invention is not restricted to this but is also applicable to another image generating apparatus other than the thermal transfer printer so far as the same performs printing by rotating a print head and pressing an ink sheet.

While the thermal transfer printer cleans the print head 2 by rotating the same at the speed higher than that in printing in the aforementioned embodiment, the present invention is not restricted to this but the thermal transfer printer may alternatively clean the print head 2 by rotating the same at the same speed as that in printing.

While the thermal transfer printer cleans the print head 2 by rotating the same between the printing position and the separate position (see FIG. 18) higher than the printing standby position (see FIG. 11) where the print head 2 is arranged when the ink sheet search sensor 34 searches for the ink sheet 32 in printing in the aforementioned embodiment, the present invention is not restricted to this but the thermal transfer printer may alternatively clean the print head 2 by rotating the same between the printing position and the printing standby position where the print head 2 is arranged when the ink sheet search sensor 34 searches for the ink sheet 32 in printing.

While the thermal transfer printer cleans the print head 2 by rotating the same between the printing position (see FIG. 16) and the separate position (see FIG. 18) a plurality of times in the aforementioned embodiment, the present invention is not restricted to this but the thermal transfer printer may alternatively clean the print head 2 by rotating the same between the printing position and the separate position only once.

What is claimed is:

1. An image generating apparatus comprising:

an apparatus body including a print head provided to be rotatable between a printing position where said print head is pressed against a platen roller and a nonprinting position where said print head is separated from said platen roller; and an ink sheet cartridge, detachably mounted on said apparatus body, storing an ink sheet held between said print head and said platen roller in printing, and a controller to control said print head by rotating said print head between said printing position and said nonprinting position thereby dropping foreign matter adhering to said print head onto said ink sheet when sensing arrival of the rear end of said ink sheet, thereby cleaning said print head, wherein said controller controls said print head to perform at least an operation of rotating said print head from said printing position to said nonprinting position in cleaning at a rotational speed higher than that for rotating said print head in printing.

2. The image generating apparatus according to claim 1, wherein said print head is brought into contact with said ink sheet when rotated to said printing position in cleaning of said print head.

3. The image generating apparatus according to claim 1, wherein said nonprinting position for said print head includes a first nonprinting position where said print head is arranged when the image generating apparatus searches for said ink sheet in printing and a second nonprinting position, higher than said first nonprinting position, where said print head is arranged after completion of printing, so that the image generating apparatus cleans said print head by rotating said print head between said printing position and said second nonprinting position.

4. The image generating apparatus according to claim 1, performing an operation of rotating said print head in cleaning by rotating said print head between said printing position and said nonprinting position a plurality of times.

5. The image generating apparatus according to claim 1, further comprising an ink sheet sensor for searching for said ink sheet by sensing a prescribed region of said ink sheet, for sensing arrival of the rear end of said ink sheet and cleaning said print head when said ink sheet sensor no longer senses said prescribed region of said ink sheet.

6. The image generating apparatus according to claim 5, wherein said ink sheet includes an ink sheet search identification portion provided on said prescribed region, so that the image generating apparatus senses arrival of the rear end of said ink sheet if said ink sheet sensor does not sense said ink sheet search identification portion upon carriage of said ink sheet by a prescribed length.

7. The image generating apparatus according to claim 1, further comprising an alarm portion prompting the user to exchange said ink sheet cartridge after completely cleaning said print head.

8. The image generating apparatus according to claim 7, wherein said alarm portion includes a light-emitting device portion.

9. The image generating apparatus according to claim 1, further comprising a plurality of rotatable pressing members pressing said print head against said platen roller, for rotating said print head between said printing position and said nonprinting position by rotating said pressing members.

10. An image generating apparatus comprising:

an apparatus body including a print head provided to be rotatable between a printing position where said print head is pressed against a platen roller and a nonprinting position where said print head is separated from said platen roller;

an ink sheet cartridge, detachably mounted on said apparatus body, storing an ink sheet held between said print head and said platen roller in printing; and a controller to control said print head by rotating said print head between said printing position and said nonprinting position thereby dropping foreign matter adhering to said print head onto said ink sheet when sensing arrival of the rear end of said ink sheet, thereby cleaning said print head, and performing at least an operation of rotating said print head from said printing position to said nonprinting position in cleaning at a rotational speed higher than that for rotating said print head in printing, wherein said nonprinting position for said print head includes a first nonprinting position where said print head is arranged when the image generating apparatus searches for said ink sheet in printing and a second nonprinting position, higher than said first nonprinting position, where said print head is arranged after completion of printing, so that the image generating apparatus cleans said print head by rotating said print head between said printing position and said second nonprinting position, the image generating apparatus performs said operation of rotating said print head in cleaning by rotating said print head between said printing position and said nonprinting position a plurality of times, and the image generating apparatus further comprises an ink sheet sensor for searching for said ink sheet by sensing a prescribed region of said ink sheet, for sensing arrival of the rear end of said ink sheet and cleaning said print head when said ink sheet sensor no longer senses said prescribed region of said ink sheet.

11. The image generating apparatus according to claim 10, wherein said print head is brought into contact with said ink sheet when rotated to said printing position in cleaning of said print head.

12. The image generating apparatus according to claim 10, wherein said ink sheet includes an ink sheet search identification portion provided on said prescribed region, so that the image generating apparatus senses arrival of the rear end of said ink sheet if said ink sheet sensor does not sense said ink sheet search identification portion upon carriage of said ink sheet by a prescribed length.

13. The image generating apparatus according to claim 10, further comprising an alarm portion prompting the user to exchange said ink sheet cartridge after completely cleaning said print head.

14. The image generating apparatus according to claim 13, wherein said alarm portion includes a light-emitting device portion.

15. The image generating apparatus according to claim 10, further comprising a plurality of rotatable pressing members pressing said print head against said platen roller, for rotating said print head between said printing position and said nonprinting position by rotating said pressing members.

* * * * *